US009837721B2

(12) United States Patent
Huynh

(10) Patent No.: US 9,837,721 B2
(45) Date of Patent: Dec. 5, 2017

(54) LOW PROFILE DIPOLE ANTENNA ASSEMBLY

(71) Applicant: NovAtel Inc., Calgary (CA)

(72) Inventor: Son Huy Huynh, Redondo Beach, CA (US)

(73) Assignee: NovAtel Inc., Calgary, CA (US)

( * ) Notice: Subject to any disclaimer, the term of this patent is extended or adjusted under 35 U.S.C. 154(b) by 373 days.

(21) Appl. No.: 14/150,404

(22) Filed: Jan. 8, 2014

(65) Prior Publication Data

US 2015/0194731 A1 Jul. 9, 2015

Related U.S. Application Data

(60) Provisional application No. 61/752,026, filed on Jan. 14, 2013.

(51) Int. Cl.
*H01Q 1/48* (2006.01)
*H01Q 9/28* (2006.01)
*H01Q 5/335* (2015.01)

(52) U.S. Cl.
CPC ..... *H01Q 9/285* (2013.01); *H01Q 5/335* (2015.01)

(58) Field of Classification Search
CPC H01Q 9/16; H01Q 9/285; H01Q 1/38; H01Q 5/378; H01Q 9/30; H01Q 19/24; H01Q 19/30
USPC ..... 343/747, 792, 821
See application file for complete search history.

(56) References Cited

U.S. PATENT DOCUMENTS 3,239,838 A * 3/1966 Kelleher ..... H01Q 9/065 343/789
3,727,231 A 4/1973 Galloway et al.
4,084,162 A * 4/1978 Dubost ..... H01Q 9/065 343/700 MS
4,410,893 A 10/1983 Griffee
4,737,797 A * 4/1988 Siwiak ..... H01Q 9/065 333/26
5,892,486 A * 4/1999 Cook ..... H01Q 9/285 343/795
6,018,324 A * 1/2000 Kitchener ..... H01Q 1/38 343/702
6,864,853 B2 * 3/2005 Judd ..... H01Q 1/007 343/700 MS
7,339,542 B2 * 3/2008 Lalezari ..... H01Q 5/00 343/730

(Continued)

*Primary Examiner* — Linh Nguyen
(74) *Attorney, Agent, or Firm* — Cesari and McKenna, LLP

(57) ABSTRACT

A compact, low profile dipole antenna assembly includes first and second linear radiating elements that form the positive and negative sides of the dipole antenna, and a balun that extends in parallel with the second radiating element, i.e., the negative side of the dipole antenna. The second radiating element is connected to ground at one end and is an open circuit at an opposite end. A main feed line, which is part of the balun, also connects to a common ground with the second radiating element. The balun and the connection to ground act as an impedance transformer, and the second radiating element acts as the negative side of the dipole antenna as well as a ground plane for the balun. The balun and the second radiating element share a volume with the second radiating element electrically shielding the balun, and the main feed probe connecting to ground within the shared volume.

20 Claims, 4 Drawing Sheets

(56) References Cited

U.S. PATENT DOCUMENTS

| | | | | |
|---|---|---|---|---|
| 7,456,799 | B1 * | 11/2008 | Cohen | H01Q 1/1242 343/773 |
| 7,724,201 | B2 * | 5/2010 | Nysen | H01Q 1/2275 343/700 MS |
| 8,228,257 | B2 * | 7/2012 | Lalezari | H01Q 9/28 343/792 |
| 8,537,066 | B2 * | 9/2013 | Libonati | H01Q 9/28 343/772 |
| 8,786,503 | B2 * | 7/2014 | Apostolos | H01Q 1/273 343/727 |
| 2007/0132650 | A1 * | 6/2007 | Lalezari | H01Q 5/00 343/773 |
| 2012/0188137 | A1 * | 7/2012 | Lalezari | H01Q 21/10 343/773 |
| 2013/0201073 | A1 * | 8/2013 | Singleton | H01Q 9/0485 343/859 |

* cited by examiner

LOW PROFILE DIPOLE ANTENNA ASSEMBLY

CROSS-REFERENCE TO RELATED APPLICATION

The present application claims the benefit of U.S. Provisional Patent Application Ser. No. 61/752,026, which was filed on Jan. 14, 2013, by Son Huy Huynh for a LOW PROFILE DIPOLE ANTENNA ASSEMBLY and is hereby incorporated by reference.

BACKGROUND OF THE INVENTION

Field of the Invention

The invention relates generally to dipole antennas and, in particular, to dipole antenna assemblies.

Background Information

A dipole antenna is a well known type of antenna that consists of two radiating elements that are center fed. The two radiating elements operate as positive and negative sides, or halves, of the dipole antenna. Due to the configuration of the antenna (that is, where the ends of the antenna correspond to anti-nodes and the center to nodes), the antenna resonates well.

Dipole antennas are considered balance devices because they are symmetrical and work best when they are fed with a balanced current. In other words, the current is of equal size on both halves (e.g., and phase shifted 180 degrees). When the antenna is fed with an unbalanced feed, such as a coaxial cable, the antenna assembly typically includes a type of circuit or transformer called a balun (from BALanced and UNbalanced).

Generally, a dipole antenna assembly has a "T" shaped configuration, in which the two radiating elements extend outwardly in different directions from one another and are arranged perpendicular to the balun. To increase the bandwidth and/or improve the performance of the dipole antenna, the respective antenna radiating elements may also have various shapes, which increases the width of dipole antenna assembly. The configuration of the antenna assembly and the various shapes of the antenna elements result in dipole antenna assemblies that overall are large and ungainly. While the relatively large overall size and configuration of the assemblies may be suitable for use with many types of devices, the size and configuration are not well suited for use with handheld devices and, in particular, handheld communication devices, which are being designed smaller, thinner and sleeker. Further, the configurations with or without shaped antenna elements are not aesthetically pleasing for such handheld communication devices.

SUMMARY OF THE INVENTION

A compact, low profile dipole antenna assembly includes first and second linear radiating elements that form the positive and negative sides of the dipole antenna, and a balun that extends in parallel with the second radiating element, i.e., the negative side of the dipole antenna. The second radiating element is connected to ground at one end and is an open circuit at an opposite end. A main feed line, which is part of the balun, also connects to a common ground with the second radiating element. The balun and the connection to ground act as an impedance transformer, and the second radiating element acts as the negative side of the dipole antenna as well as a ground plane for the balun. The balun and the second radiating element share a volume, with the second radiating element electrically shielding the balun and the main feed probe connecting to ground within the shared volume.

BRIEF DESCRIPTION OF THE DRAWINGS

The invention description below refers to the accompanying drawings, of which.

DETAILED DESCRIPTION OF AN ILLUSTRATIVE EMBODIMENT

Figure 3:
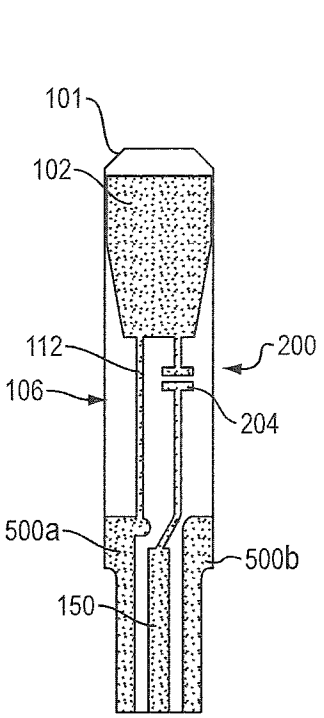
FIG. 3 depicts the dipole antenna assembly of FIGS. 1A and 1B with an optional tuning circuit.

Referring to FIGS. 1A and 1B and FIGS. 2A-C, a compact, low profile dipole antenna assembly 100 includes first and second radiating elements 102, 103 that form the positive and negative sides, or halves, of a dipole antenna 104. The radiating elements are printed on opposite sides of a dielectric substrate 101. FIG. 1 depicts the second radiating element 103, which is on the back side of the dielectric substrate 101, as a dotted line.

Figure 2C:
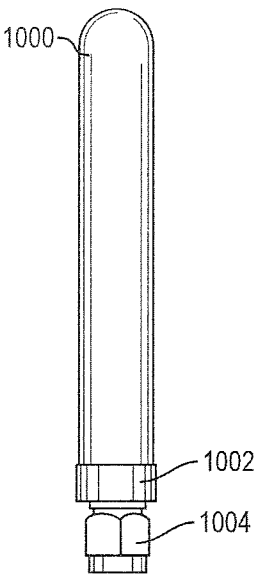
FIGS. 2A-C depict various components of the dipole antenna assembly of FIGS. 1A and 1B in more detail.
Figure 2B:
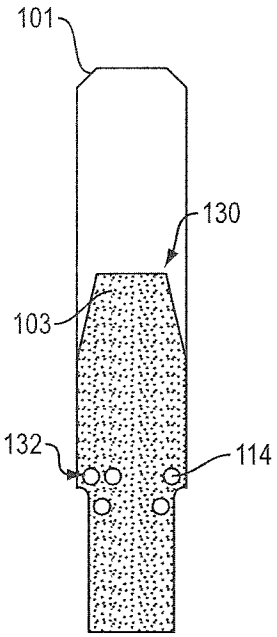

A balun 106 is printed on the same side of the dielectric substrate 101 as the first radiating element 102. The balun connects between the radiating element 102 and an antenna feed circuit 150, that connects, in turn, through an edge launch connector (not shown) to an external connector 1004 (FIG. 2C). The balun 106 includes a main feed probe 110 and a balun feed circuit 112 that operate to provide signal and return paths between the dipole antenna 104 and the antenna feed circuit 150. The balun is arranged in parallel with the second radiating element 103.

The second radiating element 103 connects to the main ground of the antenna feed circuitry through one or more signal ground vias 114 that are positioned at a bottom end 132 of the second radiating element 103. A second, opposite end 130 of the second radiating element is an open circuit, and thus, the end 132 connected to ground is an RF short circuit.

Figure 2A:
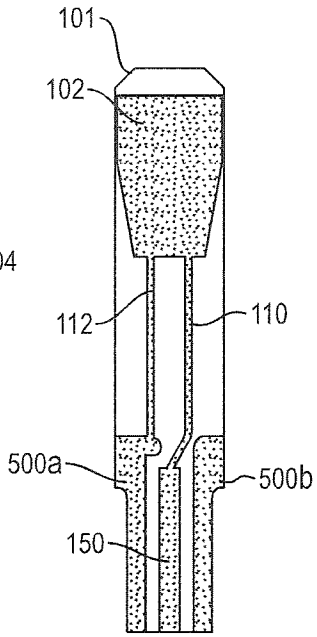

The first and second radiating elements 102, 103 and the balun 106, that is, the main feed probe 110 and the balun feed circuit 112 are all respectively approximately $0.25\lambda/\sqrt{\in}$ in length, where $\lambda$ is the wavelength of interest. The radiating elements may be approximately $0.08\lambda/\sqrt{\in}$ in width, and the ends of the respective radiating elements may be tapered, as illustrated in FIG. 2A, to provided increased bandwidth.

The main feed probe 110 and the balun feed circuit 112 operate as an impedance transformer at the frequency of interest. Accordingly, the open end 130 of the second radiating element 103, which is in a region proximate to the connection of the main feed probe 110 to the first radiating element, has low impedance and the end 132 connected to ground has high impedance. The first and second radiating elements thus operate together as the positive and negative sides, respectively, of the dipole antenna 104.

The second radiating element 103 also provides a path to ground for the main feed probe 110, and acts as a ground plane for the balun 106. The balun and the second radiating element thus share a common volume and the second radiating element electrically shields the balun. Notably, the main feed probe connects to ground on the inside of the shared volume, and thus, the various components can operate in close proximity.

The configuration of the linear radiating elements with the balun in parallel with the second radiating element and also sharing a common volume with the second radiating element allows the balun and the second radiating element to operate together in close proximity as a ground plane, radiator, main feed network and balun. The result is a compact and low profile dipole antenna assembly that is particularly suited for use with a handheld communication device.

To ensure an equal potential is maintained with the main ground of the antenna feed circuitry 150, one or more feed circuit mode suppressors 500*a* and 500*b* may be included on the same side of the dielectric substrate 101 as the balun 106. A plurality of plated ground vias 502 provide connections between the mode suppressors and the main ground, that is, the ground of the antenna feed circuitry. The suppressors 500*a* and 500*b* connect to one another through the ground of the edge connector 1006 (FIG. 1B) in the antenna feed circuitry 150, and operate to minimize surface waves from higher order modes.

Figure 1A:
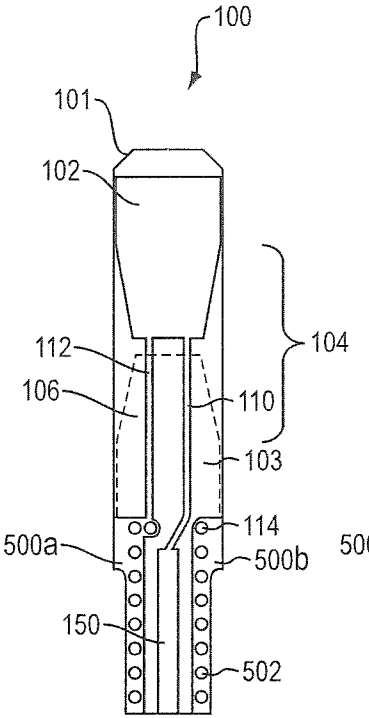
FIGS. 1A and 1B depict a dipole antenna assembly constructed in accordance with the invention.
Figure 1B:
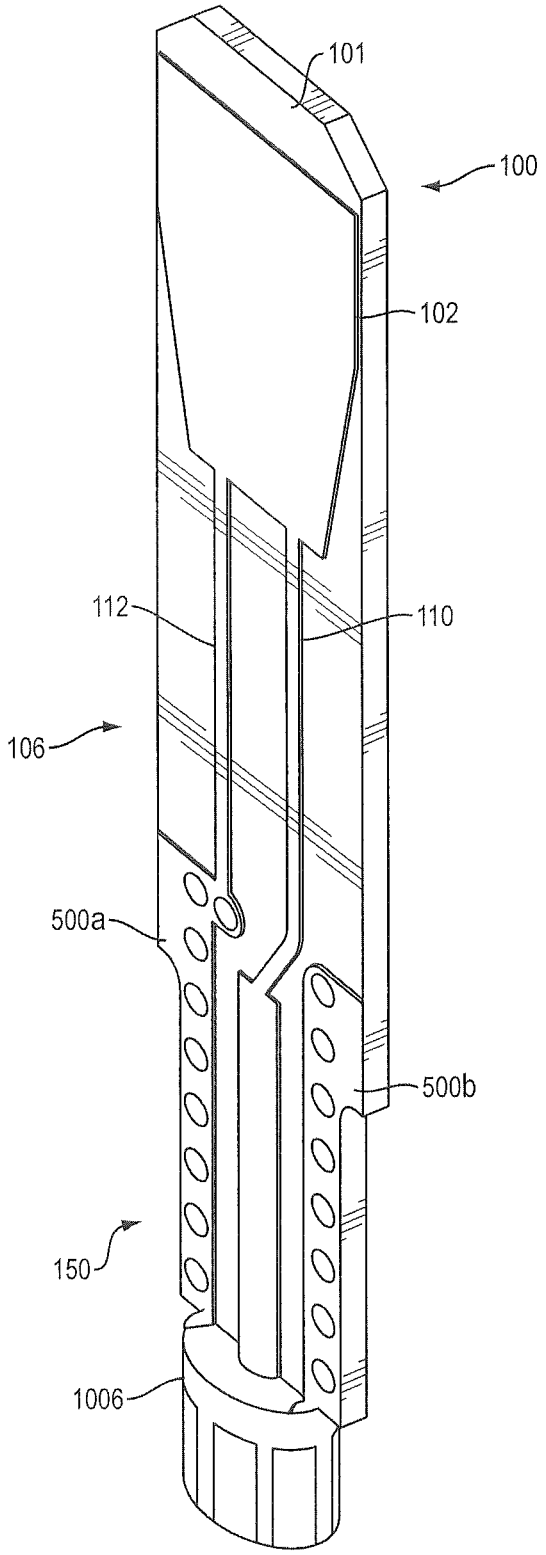

FIG. 1B depicts a side view of the compact, low profile dipole antenna assembly 100.

Referring now also to FIG. 3, a tuning circuit 200 may be included to improve input impedance matching and radiator bandwidth performance. The tuning circuit 200 includes a capacitor 204 which may be tunable and may also further include an inductor (not shown) in series or in parallel with the capacitor 204. The drawing depicts the tuning circuit 200 as an in-line capacitor.

As shown in FIG. 2C, a radome 1000 fits over the antenna assembly 100 and connects to a base plate 1002 that supports the dielectric substrate 101 and the external connector 1004, to form an enclosure for the dipole antenna assembly 100.

Figure 4B:
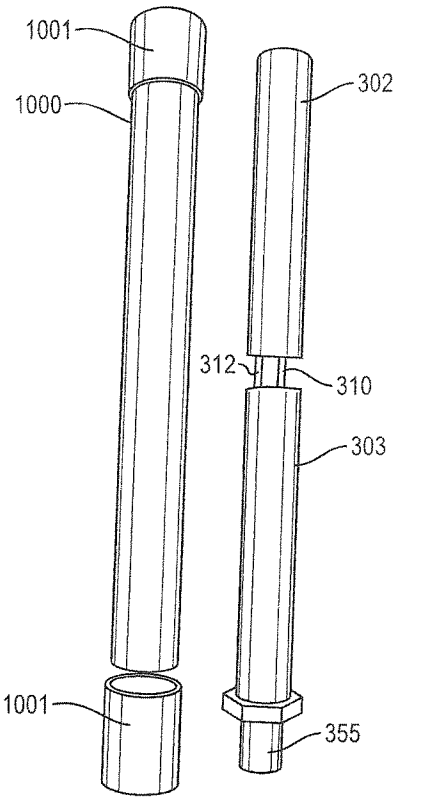
FIGS. 4A and 4B depict an alternative dipole antenna assembly constructed in accordance with the invention.
Figure 4A:
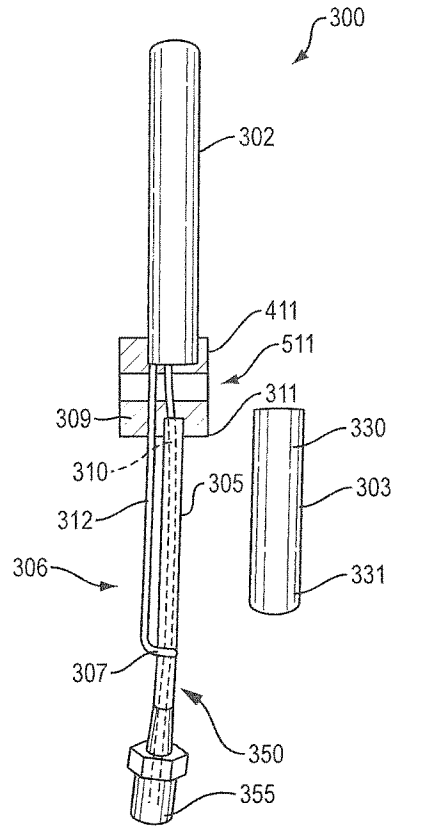

FIGS. 4A-B illustrate a compact dipole antenna assembly 300 constructed using tubes 302 and 303 as the first and second radiating elements. A balun 306 extends within the tube 303, which operates as the negative side of the dipole antenna. The length of the tubes is approximately $0.25\lambda/\sqrt{\in}$, and the tubes are approximately $0.08\lambda/\sqrt{\in}$ in width.

Figure 5:
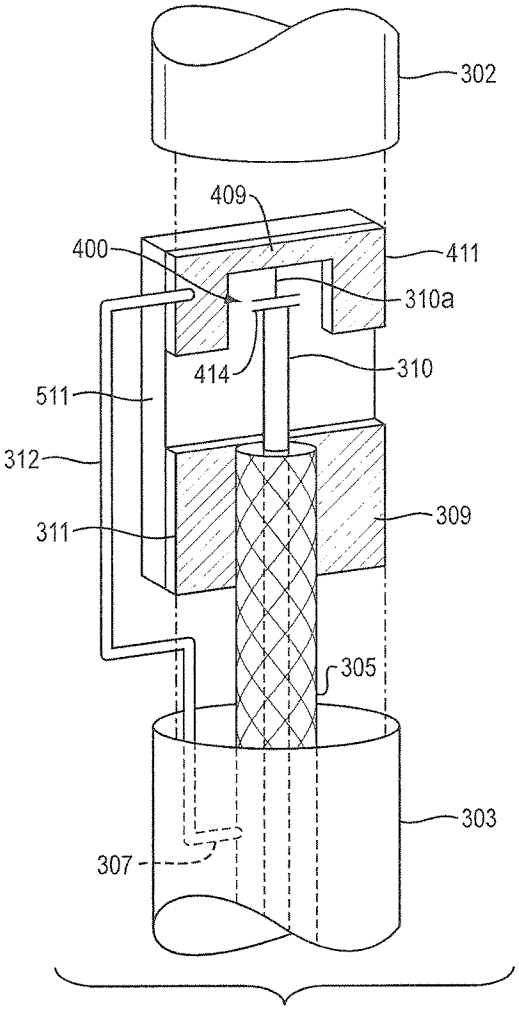
FIG. 5 depicts a section of the dipole antenna assembly of FIGS. 4A and 4B in more detail.

As shown in FIGS. 4A, 4B and 5, a main feed probe 310 is a center conductor of a ground connector 305. The main feed probe is part of the antenna feed circuitry 350, which also includes an external connector ground 355 that connects to an external signal line (not shown). The main feed probe 310 also connects to the first radiating element 302 and to a balun feed circuit 312 through connections to copper conductive lines 409 on a first conductive section 411 of a circuit board support 511. The balun feed circuit 312 connects on an opposite end to the ground connector 305 by a connection 307. The main feed probe 310, the balun feed circuit 312 and interconnections 307 and 409 form the balun 306. Conductive lines 309 on a second conductive section 311 of the circuit board support 511 provide a ground connection between the ground connector 305 and an end 330 of the second radiating element 303.

An opposite end 331 of the second radiating element is an open circuit, and the end 330 connected to ground acts as an RF short circuit. The main feed probe 310, the balun feed circuit 312 and the ground connector 305 operate as an impedance transformer, and the end 330 of the second radiating element that is in proximity to the main feed probe has low impedance. The second radiating element 303 acts as a negative radiator, a ground enclosure for the main feed probe 310 and a ground plane for the balun 306.

The balun 306 and the second radiating element 303 are configured in parallel, with the balun inside the second radiating element. Accordingly, the balun and the second radiating element, which acts also as the ground plane for the balun, share a common volume. Notably, the ground connection for the main feed probe is inside the shared volume, and the balun and the ground connection are electrically shielded by the second radiating element 303. The configuration results in the various components being capable of operating in close proximity and produces a compact and a low profile dipole antenna assembly 300 that is well suited for handheld communication devices and so forth. As shown in FIG. 4B, a radome 1000 with end caps 1001 may enclose the antenna assembly 300.

FIG. 5 depicts an optional tuning circuit 400 that connects between the first radiating element 302 and the main feed probe 310. The tuning circuit, which operates in a known manner, may be included to improve input impedance matching and radiator bandwidth performance. The tuning circuit 400 depicted as a capacitor 414 may also further include an inductor (not shown) in series or in parallel with the capacitor 414. The capacitor 414 may also be tunable. With the tuning circuit 400 in place, the main feed probe 310 connects to the second radiating element 302 through the tuning circuit, here the capacitor 414, and a main feed line extension 310*a* that connects to the copper conductive lines 409.

For ease of understanding, the drawings depict the circuit board support 511 exaggerated in size relative to the first and second radiating elements, and the respective connections to the conducting lines 309 and 409 are not explicitly shown.

The tubular arrangement of FIGS. 4A, 4B and 5 may be used with lower frequencies to provide higher power. For ease of manufacture, the printed circuit arrangement of FIGS. 1A-3 may be used with higher frequencies.

Figure 6B:
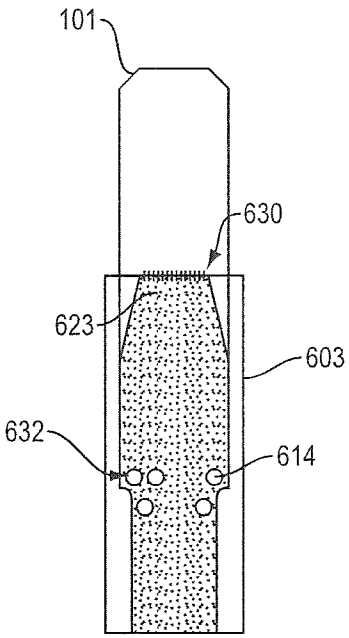
FIGS. 6A and 6B depict an alternative dipole antenna assembly constructed in accordance with the invention.
Figure 6A:
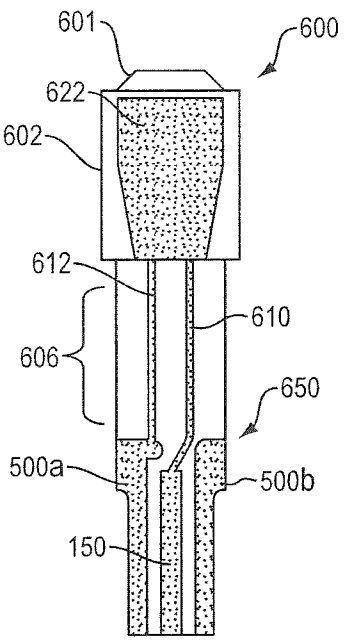

Referring now to FIGS. 6A and 6B, a large volume compact dipole antenna assembly 600 includes a balun 606, with a main feed probe 610 and a balun feed circuit 612, formed as a printed circuit on a first side of a dielectric substrate 601. An associated ground plane 623 is printed on an opposite side of the dielectric. The balun 606 connects also to an antenna feed circuit 650. The radiating elements of the antenna assembly 600 include tubes 602 and 603 that are selectively connected to respective antenna components that are printed on the substrate 601. The use of both printed circuit components and tubular components provides a compact low profile dipole antenna with a large volume, which can be efficiently and cost effectively manufactured.

The balun 606 connects electrically to the positive radiating element of the antenna assembly 600. For ease of manufacture, the balun 606 may connect to a printed element 622 that is, in turn, connected to the tube 602. The tube 602, which is similar to the tube 302 of FIG. 4, electrically connects to the element 622 along the length of the element 622, by, for example, soldering, to form the positive radiating element of the antenna assembly. The tube 603, which is similar to the tube 303 of FIG. 4, electrically connects, for example by soldering, to a top end 630 of the ground plane 623, to form the negative radiating element of the antenna assembly. The ground plane 623 connects also to the ground of the antenna feed circuit 650 through vias 614 at a bottom end 632 of the ground plane. Further, a plurality of feed circuit mode suppressors 500*a* and 500*b* and associated vias (not shown) may be included in the antenna assembly 600 in the manner discussed above with reference to FIG. 1. In addition, a tuning circuit (not shown) may be included in the antenna assembly 600 in the manner discussed above with reference to FIG. 3.

The dipole antenna assembly 600 provides a large volume that is useful with lower frequencies to provide more band width, and includes printed circuit components that are very efficiently manufactured.

What is claimed is:

1. A dipole antenna assembly consisting of a first linear radiating element;

a second linear radiating element having two ends, with one end an open circuit and an opposite end, wherein the opposite end is connected to a ground;

a balun extending in parallel with the second radiating element and electrically connecting to the first linear radiating element, wherein the balun comprises a main probe and a balun feed circuit, wherein the main probe and the balun feed circuit are electrically connected to the first linear radiating element;

the second radiating element acting as a ground plane for the balun and sharing a common volume with the balun, with a ground connection of the main probe occurring within the common volume.

2. The dipole antenna assembly of claim 1 wherein the first and second radiating elements have lengths of approximately 0.25 the wavelength of interest.

3. The dipole antenna assembly of claim 2 wherein the balun has a length of approximately 0.25 the wavelength of interest.

4. The dipole antenna assembly of claim 3 wherein the first radiating element and the balun are printed on a first side of a dielectric substrate, the second radiating element is printed on a second side of the dielectric substrate, the ground connection of the second end of the second radiating element is by vias extending through the dielectric substrate, and the second radiating element acts as a path to ground for the main feed probe.

5. The dipole antenna assembly of claim 3 wherein the first and second radiating elements are collinear tubes, the balun extends within the tube that is the second radiating element, and the second radiating element forms a ground enclosure for a ground connector that connects the main feed probe to ground.

6. The dipole antenna assembly of claim 1 further including a tuning circuit connected between the main feed probe and the first radiating element.

7. The dipole antenna assembly of claim 6 wherein the tuning circuit consists of a capacitor.

8. The dipole antenna assembly of claim 7 wherein the tuning circuit further includes an inductor in series or in parallel with the capacitor.

9. The dipole antenna of claim 7 wherein the capacitor is tunable.

10. The dipole antenna assembly of claim 1 wherein the first radiating element is a positive side of the dipole antenna, and the second radiating element is a negative side of the dipole antenna.

11. The dipole antenna of claim 3 wherein the first and second radiating elements have widths of approximately 0.08 the wavelength of interest.

12. The dipole antenna of claim 11 wherein one or both of the first and second radiating elements have tapered ends.

13. The dipole antenna of claim 1 further including a radome.

14. The dipole antenna assembly of claim 4 further including feed circuit mode suppressors on the same side of the dielectric as the balun, the suppressors connecting to ground through a plurality of vias.

15. The dipole antenna assembly of claim 3 wherein the balun is printed on a first side of a dielectric substrate, a ground plane is printed on a second side of the dielectric substrate with a first end of the ground plane electrically connected to ground in common with the balun, the second radiating element includes the ground plane and a second tube that connects to a second end of the ground plane and extends over the ground plane and the balun; and the first radiating element comprises a first tube that is collinear with the second tube.

16. The dipole antenna assembly of claim 15 wherein the first radiating element further comprises a printed element that electrically interconnects the balun and the first tube.

17. The dipole antenna assembly of claim 16 wherein the ground connection of the first end of the ground plane is by one or more vias extending through the dielectric substrate.

18. The dipole antenna assembly of claim 1 further including feed circuit mode suppressors on the same side of the dielectric as the balun, the suppressors connecting to ground through a plurality of vias.

19. The dipole antenna assembly of claim 15 further including a tuning circuit connected to the main feed probe.

20. The dipole antenna assembly of claim 19 wherein the tuning circuit consists of one or more of a capacitor, a tunable capacitor and an inductor.

* * * * *